US006253036B1

(12) United States Patent
Karakama et al.

(10) Patent No.: US 6,253,036 B1
(45) Date of Patent: Jun. 26, 2001

(54) ELECTROPHOTOGRAPHIC IMAGE FORMING APPARATUS, PROCESS CARTRIDGE, DEVELOPING DEVICE AND MEASURING PART

(75) Inventors: Toshiyuki Karakama, Shizuoka-ken; Shirou Sakata; Hideki Matsumoto, both of Mishima; Akiyoshi Yokoi, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/411,388

(22) Filed: Oct. 4, 1999

(30) Foreign Application Priority Data

Oct. 9, 1998 (JP) ..... 10-303344

(51) Int. Cl.[7] ..... G03G 15/08
(52) U.S. Cl. ..... 399/27; 399/119
(58) Field of Search ..... 399/27, 9, 24, 399/25, 30, 61, 62, 111, 119, 120; 73/304 C; 222/DIG. 1

(56) References Cited

U.S. PATENT DOCUMENTS

| | | | |
|---|---|---|---|
| 4,133,453 | 1/1979 | Ohbora | 222/39 |
| 4,296,630 | 10/1981 | Jung et al. | 73/304 |
| 4,592,645 | 6/1986 | Kanai et al. | 355/14 |
| 4,786,869 | 11/1988 | Kanai et al. | 324/207 |
| 5,294,960 | 3/1994 | Nomura et al. | 355/210 |
| 5,500,714 | 3/1996 | Yashiro et al. | 355/200 |
| 5,543,898 | 8/1996 | Shishido et al. | 355/210 |
| 5,617,579 | 4/1997 | Yashiro et al. | 399/114 |
| 5,689,774 | 11/1997 | Shishido et al. | 399/111 |
| 5,749,027 | 5/1998 | Ikemoto et al. | 399/113 |
| 5,768,660 | 6/1998 | Kurihara et al. | 399/111 |
| 5,774,766 | 6/1998 | Karakama et al. | 399/111 |
| 5,812,909 | 9/1998 | Oguma et al. | 399/103 |
| 5,828,928 | 10/1998 | Sasago et al. | 399/111 |
| 5,890,036 | 3/1999 | Karakama et al. | 399/119 |
| 5,899,602 | 5/1999 | Noda et al. | 399/111 |
| 5,940,658 | 8/1999 | Yokoi et al. | 399/119 |
| 5,943,528 | 8/1999 | Akutsu et al. | 399/110 |
| 5,966,566 | 10/1999 | Odagawa et al. | 399/109 |
| 5,987,269 * | 11/1999 | Allen et al. | 399/27 |
| 6,026,253 * | 2/2000 | Domon et al. | 399/30 |

FOREIGN PATENT DOCUMENTS

| | | |
|---|---|---|
| 5-100571 | 4/1993 | (JP) . |
| 5-188782 | 7/1993 | (JP) . |

* cited by examiner

*Primary Examiner*—Susan S. Y. Lee
*Assistant Examiner*—Hoan Tran
(74) *Attorney, Agent, or Firm*—Fitzpatrick, Cella, Harper & Scinto

(57) ABSTRACT

A process cartridge detachably mountable to an electrophotographic image forming apparatus, the process cartridge including (a) an electrophotographic photosensitive member; (b) process means actable on the electrophotographic photosensitive member; (c) a measuring electrode member having input-side and output-side electrodes having at least one juxtaposed portions, the measuring electrode member being disposed at such a position that it is contacted to a developer; (d) a reference electrode member having input-side and output-side electrodes having at least one juxtaposed portion, the reference electrode member being disposed at such a position that it is out of contact to the developer; (e) an output contact for the measuring electrode member, connected electrically to the output side electrode of the measuring electrode member; (f) an output contact for the reference electrode member, connected electrically to the output side electrode of the reference electrode member; and (g) a common input contact connected electrically to the input side electrodes of the measuring electrode member and the reference electrode member.

57 Claims, 14 Drawing Sheets

ELECTROPHOTOGRAPHIC IMAGE FORMING APPARATUS, PROCESS CARTRIDGE, DEVELOPING DEVICE AND MEASURING PART

FIELD OF THE INVENTION AND RELATED ART

The present invention relates to an electrophotographic image forming apparatus, a process cartridge, a developing device and a measuring part.

Here, the electrophotographic image forming apparatus includes an electrophotographic copying machine, an electrophotographic printer, for example, an LED printer or laser beam printer, an electrophotographic printer type facsimile, an electrophotographic printer type word, or the like.

The process cartridge is a cartridge containing as a unit an electrophotographic photosensitive member and at least one process means which is a charging means, a developing means or cleaning means, or a cartridge containing as a unit an electrophotographic photosensitive member and at least developing means as process means, the process cartridge being detachably mountable to a main assembly of an electrophotographic image forming apparatus.

Heretofore, a process cartridge has been used in an image forming apparatus using an electrophotographic image forming process. Widely used is a process cartridge, which contains as a unit an electrophotographic photosensitive member and process means actable on the electrophotographic photosensitive member, which cartridge is detachably mountable to the main assembly of the electrophotographic image forming apparatus. Such process cartridge is advantageous in that a maintenance operation can be carried out in effect by the users. Therefore, the process cartridge type electrophotographic image forming apparatus is widely used.

With such an electrophotographic image forming apparatus of a process cartridge type, the user is supposed to exchange the process cartridge, and therefore, it is desirable that there is provided means by which the user is notified of the consumption of the developer.

Heretofore, it is known that two electrode rods are provided in the developer container of the developing means, and the change of the electrostatic capacity between the electrode rods is detected to provide the amount of the developer.

Japanese Laid-open Patent Application No. HEI-5-100571 discloses a developer-detection electrode member comprising two parallel electrodes disposed on the same surface with a predetermined gap, in place of the two electrode rods, wherein the developer detection electrode member is placed on the lower surface of the developer container. It detects the developer remainder by detecting the change of the electrostatic capacity between the parallel electrodes disposed on a surface.

SUMMARY OF THE INVENTION

Accordingly, it is a principal object of the present invention to provide an electrophotographic image forming apparatus, a process cartridge, a developing device, and a developer in which a remaining amount of the developer can be detected substantially in real-time.

It is another object of the present invention to provide an electrophotographic image forming apparatus, a process cartridge, and a developing device wherein a remaining amount of developer in a developer accommodating portion can be detected substantially in real-time with the consumption of the developer.

It is a further object of the present invention to provide an electrophotographic image forming apparatus, a process cartridge, and a developing device wherein a remaining amount of the developer is detected by the electrostatic capacity between electrodes, and a measurement error attributable to a change of the ambience is compensated for, so that the detection error is minimized. It is a further object of the present invention to provide a measuring part for detecting an amount of the developer substantially in real-time in accordance with the consumption of the developer in the developer accommodating portion.

It is a further object of the present invention to provide a measuring part capable of detecting a developer remainder using a change of the electrostatic capacity between electrodes, wherein the measurement error attributable to the changes of the ambient conditions is compensated for to accomplish detection of the amount of the developer with a small detection error.

It is a further object of the present invention to provide a process cartridge, a developing device, and an electrophotographic image forming apparatus wherein the detection accuracy of an amount of a developer is improved, and the number of parts of contact portions thereof is reduced to lower the cost.

It is a further object of the present invention to provide a process cartridge, a developing device, and an electrophotographic image forming apparatus wherein assembling operativity is improved.

It is a further object of the present invention to provide a measuring part that can be manufactured with a small number of parts.

It is a further object of the present invention to provide a measuring part, wherein the assembling operativity of a developing device and a process cartridge is improved.

According to an aspect of the present invention, there is provided a process cartridge detachably mountable to an electrophotographic image forming apparatus, the process cartridge comprising (a) an electrophotographic photosensitive member; (b) process means actable on said electrophotographic photosensitive member; (c) a measuring electrode member having input-side and output-side electrodes having at least one juxtaposed portion, the measuring electrode member being disposed at such a position that it contacts a developer; (d) a reference-electrode member having input-side and output-side electrodes having at least one juxtaposed portion, the reference electrode member being disposed at such a position that it is out of contact with the developer; (e) an output contact for the measuring electrode member, connected electrically to the output-side electrode of the measuring electrode member; (f) an output contact for the reference electrode member, connected electrically to the output-side electrode of said reference electrode member; and (g) a common input contact connected electrically to the input-side electrodes of the measuring electrode member and the reference electrode member. According to another aspect of the present invention, there is provided a measuring part for detecting an amount of a developer, comprising: (a) a measuring electrode member having input-side and output-side electrodes having at least one juxtaposed portion; (b) a reference electrode member having input-side and output-side electrodes having at least one juxtaposed portion; (c) an output contact for the measuring electrode member, connected electrically to the output-side electrode of the measuring electrode member;

(d) an output contact for the reference electrode member, connected electrically to the output-side electrode of the reference electrode member; and (e) a common input contact connected electrically to the input side electrodes of the measuring electrode member and the reference electrode member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a description will be provided as to a process cartridge and an electrophotographic image forming apparatus according to embodiments of the present invention.

Figure 1:
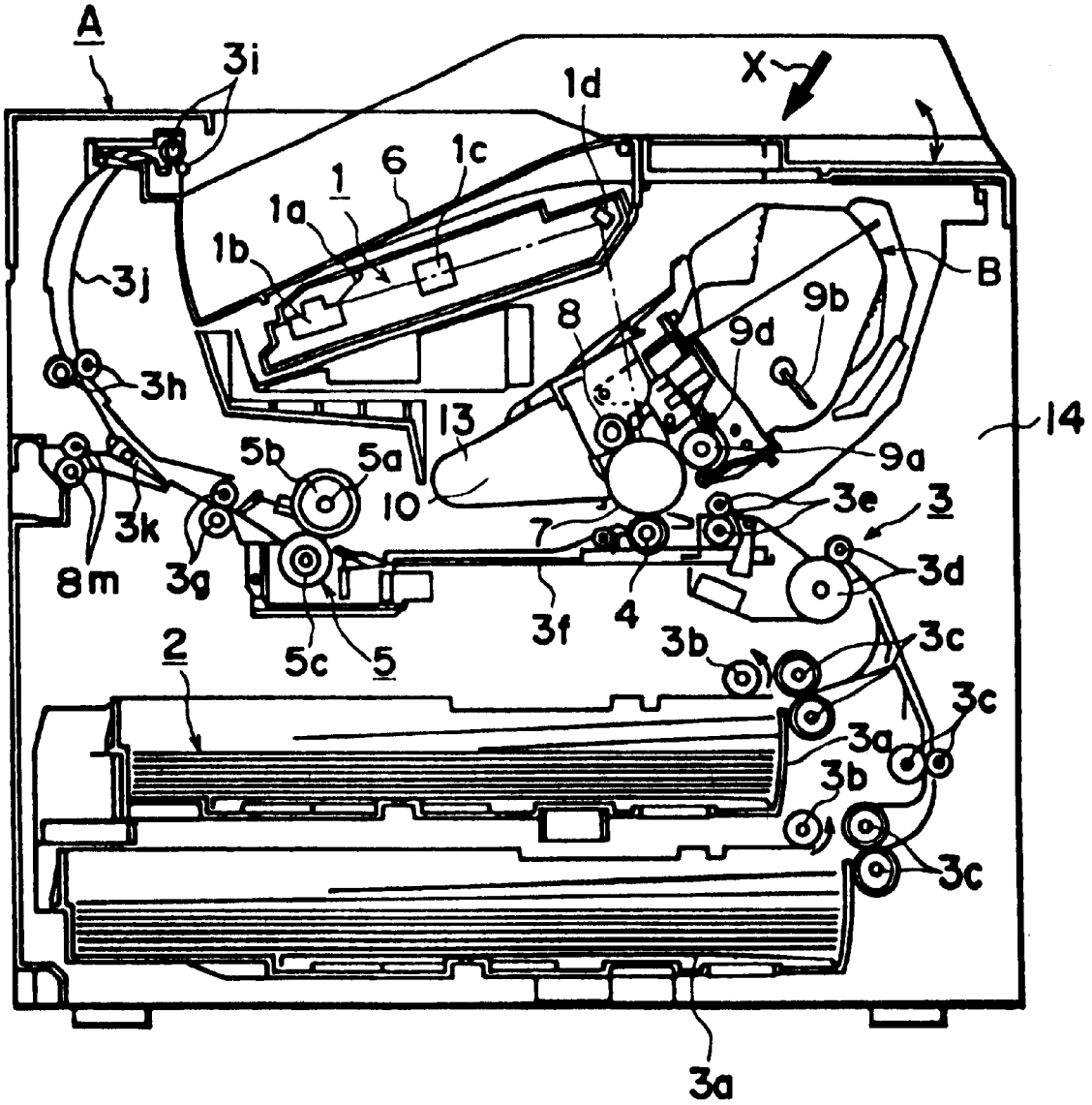
FIG. 1 shows a general arrangement of an electrophotographic image forming apparatus according to an embodiment of the present invention.
Figure 2:
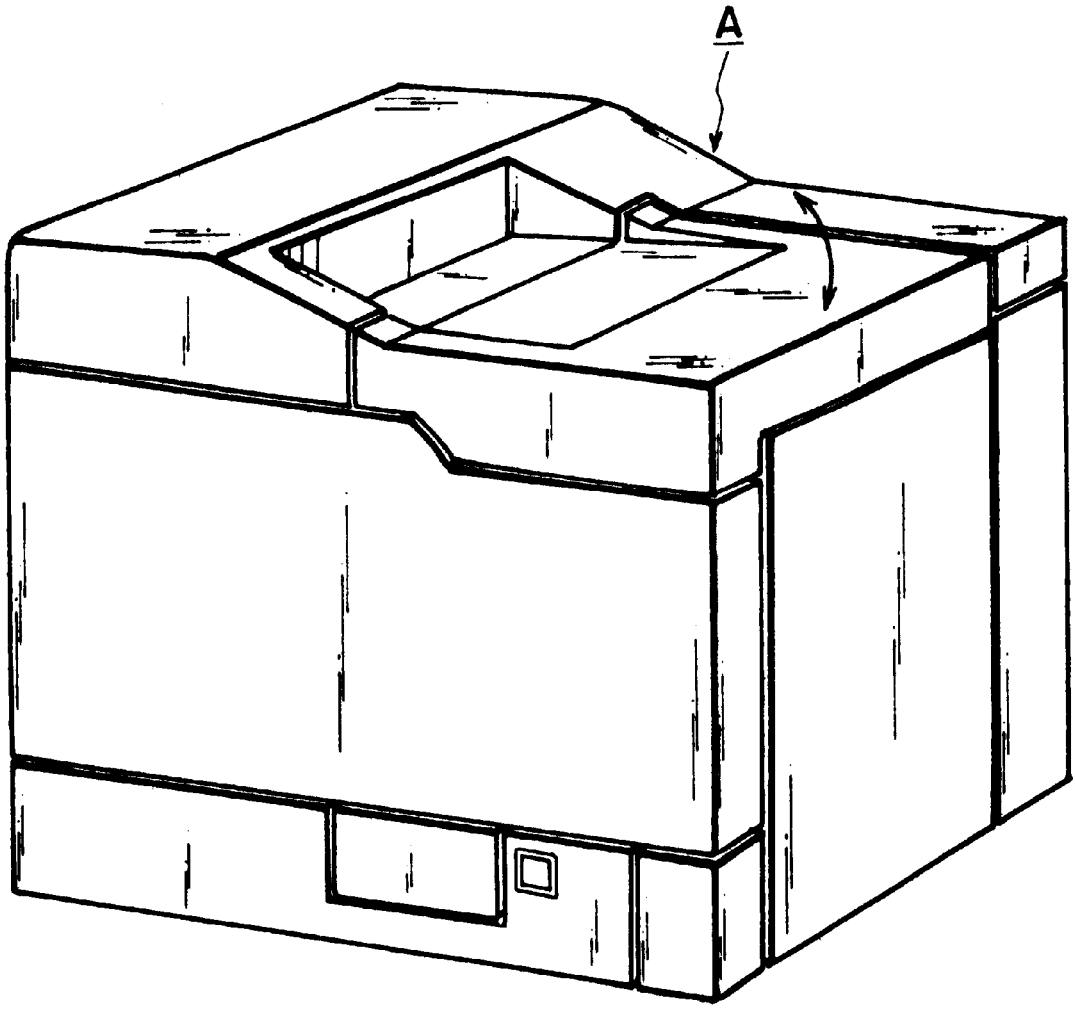
FIG. 2 is the perspective view of an outer appearance of an electrophotographic image forming apparatus according to an embodiment of the present invention.
Figure 3:
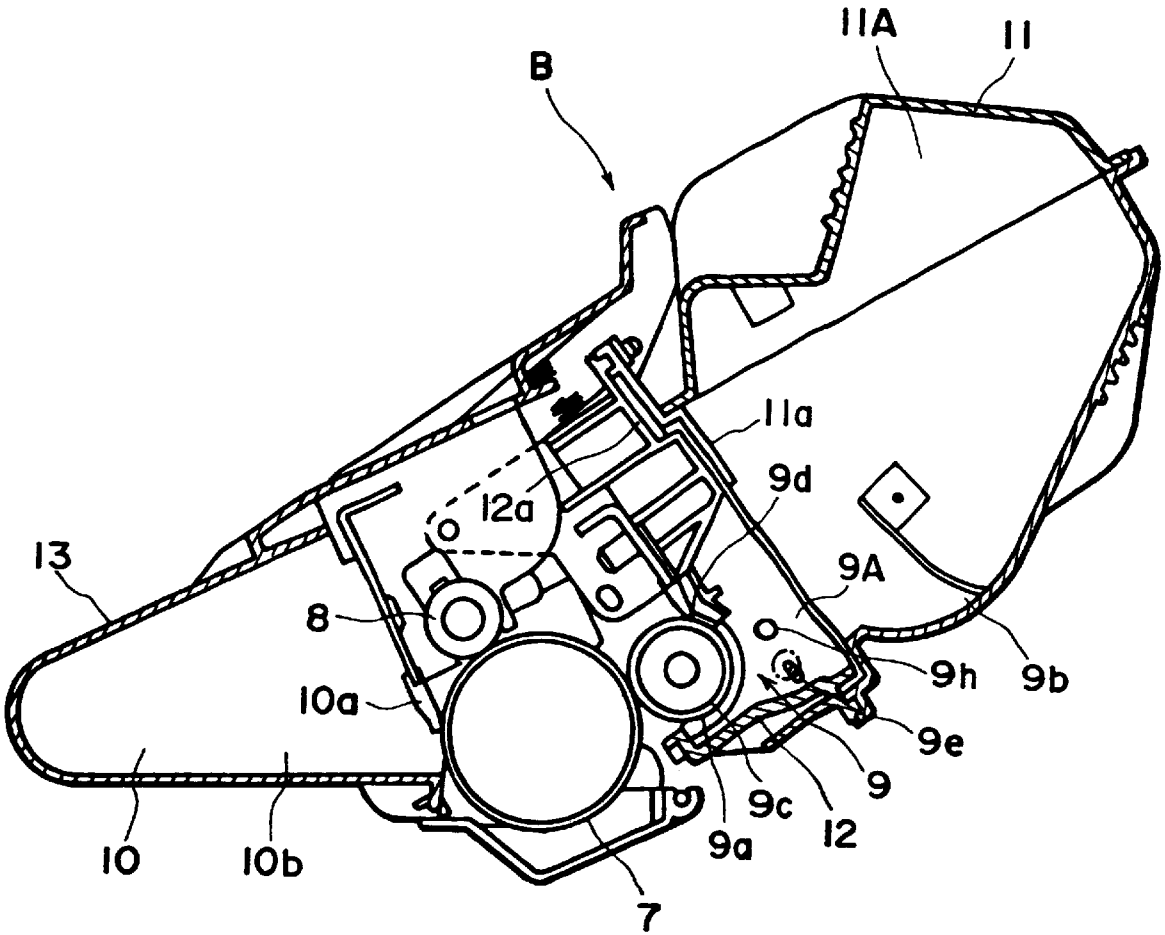
FIG. 3 is a longitudinal sectional view of a process cartridge according to an embodiment of the present invention.

Referring to FIGS. 1–3, a description will be provided as to an electrophotographic image forming apparatus to which a process cartridge is a detachably mountable, according to one embodiment of the present invention. In this embodiment, the electrophotographic image forming apparatus is in the form of a laser beam printer A of an electrophotographic type, in which images are formed on a recording material such as recording paper, an OHP sheet or textile through an electrophotographic image forming process.

The laser beam printer A comprises an electrophotographic photosensitive member, that is, a photosensitive drum 7. The photosensitive drum 7 is electrically charged by a charging roller 8 (charging means), and is exposed to a laser beam modulated in accordance with image information coming from optical means 1 including a laser diode 1*a*, a polygonal mirror 1*b*, a lens 1*c* and a reflection mirror 1*d*, so that a latent image is formed on the photosensitive drum in accordance with the image information. The latent image is developed by developing means 9 into a visualized image, that is, toner image.

The developing means 9 includes a developer chamber 9A provided with a developing roller 9*a* (developer carrying member), wherein the developer in developer container 11A (developer accommodating portion) disposed adjacent to the developer chamber 9A is fed out to a developing roller 9*a* in the developer chamber 9A by rotation of a developer feeding member 9*b*. The developer chamber 9A is provided with a developer stirring member 9*e* adjacent to the developing roller 9*a* to circulate the developer in the developer chamber. The developing roller 9*a* contains therein a fixed magnet 9*c* so that developer is fed by rotation of the developing roller 9*a*, and the developer is electrically charged by triboelectric charge by the friction with a developing blade 9*d*, and is formed into a developer layer having a predetermined thickness, which layer is supplied to a developing zone of the photosensitive drum 7. The developer the supplied to the developing zone is transferred onto the latent image on the photosensitive drum 7 so that toner image is formed. The developing roller 9*a* is electrically connected with a developing bias circuit which is normally supplied with a developing bias voltage in the form of an AC voltage biased with a DC voltage.

On the other hand, a recording material 2 in a sheet feeding cassette 3*a* is fed out and supplied to an image transfer position by a pick-up roller 3*b*, a pair of feeding rollers 3*c*, 3*d*, a pair of registration rollers, in timed relation with the formation of the toner image. In the transfer position, there is provided a transfer roller 4 (transferring means), which functions to transfer the toner image onto the recording material 2 from the photosensitive drum 7 by being supplied with a voltage.

The recording material 2 now having the toner image transferred thereonto is fed to fixing means 5 along a feeding guide 3*f*. The fixing means 5 includes driving roller 5*c* and a fixing roller 5*b* containing therein a heater 5*a* to apply pressure and heat to the recording material 2 passing therethrough to fix the toner image on the recording material 2.

The recording material is then fed by pairs of discharging rollers 3*g*, 3*h*, 3*i* and is discharged to a discharging tray 6 along a reverse path 3*j*. The discharging tray 6 is provided on a top side of the main assembly 14 of the apparatus, that is, a laser beam printer A. A deflectable flapper 3K is usable to discharge the recording material 2 by a pair of discharging rollers without using the reversing passage 3*j*. In this embodiment, the discharging rollers 3*g*, 3*h*, 3*i*, the pair of feeding rollers 3*c*, 3*d*, the pair of registration rollers, the feeding guide 3*f*, the pair of discharging rollers and the pair of discharging rollers 3*m*, constitute sheet feeding means.

The photosensitive drum 7, after the transfer roller 4 transfers the toner image onto the recording material 2, is cleaned by cleaning means 10 so that developer remaining on the photosensitive drum 7 is removed so as to be prepared for the next image forming process operation. The cleaning means 10 scrapes the remaining developer off the photosensitive drum 7 by an elastic cleaning blade provided to contact the photosensitive drum 7, and collect it to a residual developer container 10*b*.

In this embodiment, a process cartridge B includes a developing unit comprising a developer frame 11 including the developer container developer 11A accommodating the developer and the developer feeding member 9*b*, and a developing device frame 12 supporting the developing means 9, such as the developing roller 9*a*, and the developing blade 9*d*, and the process cartridge B further includes a cleaning frame 13 supporting the photosensitive drum 7, the cleaning means 10 such as the cleaning blade 10*a* and the charging roller 8.

Figure 4:
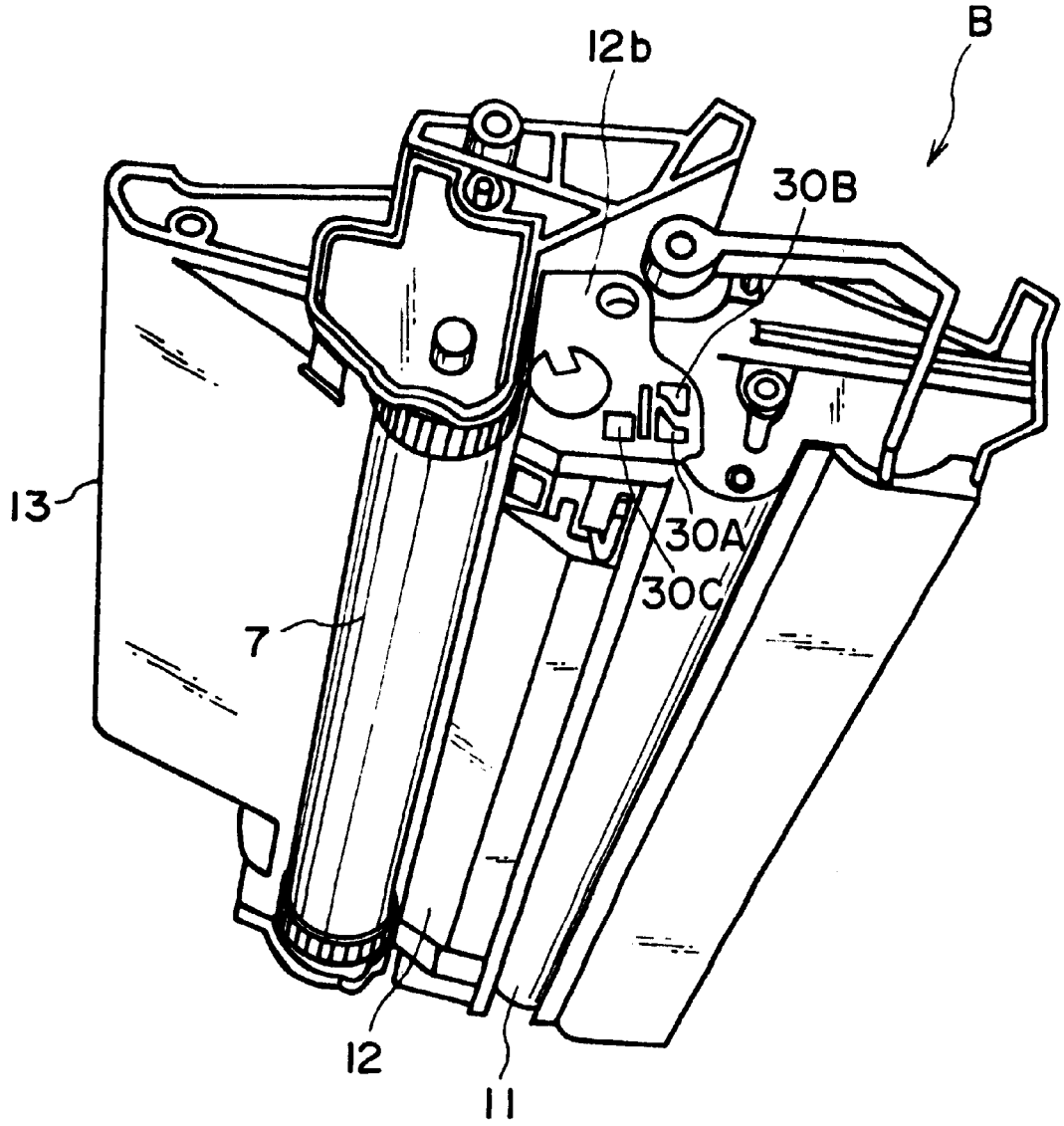
FIG. 4 is a perspective view of an outer appearance of a process cartridge according to an embodiment of the present invention, as seen from the bottom.
Figure 5:
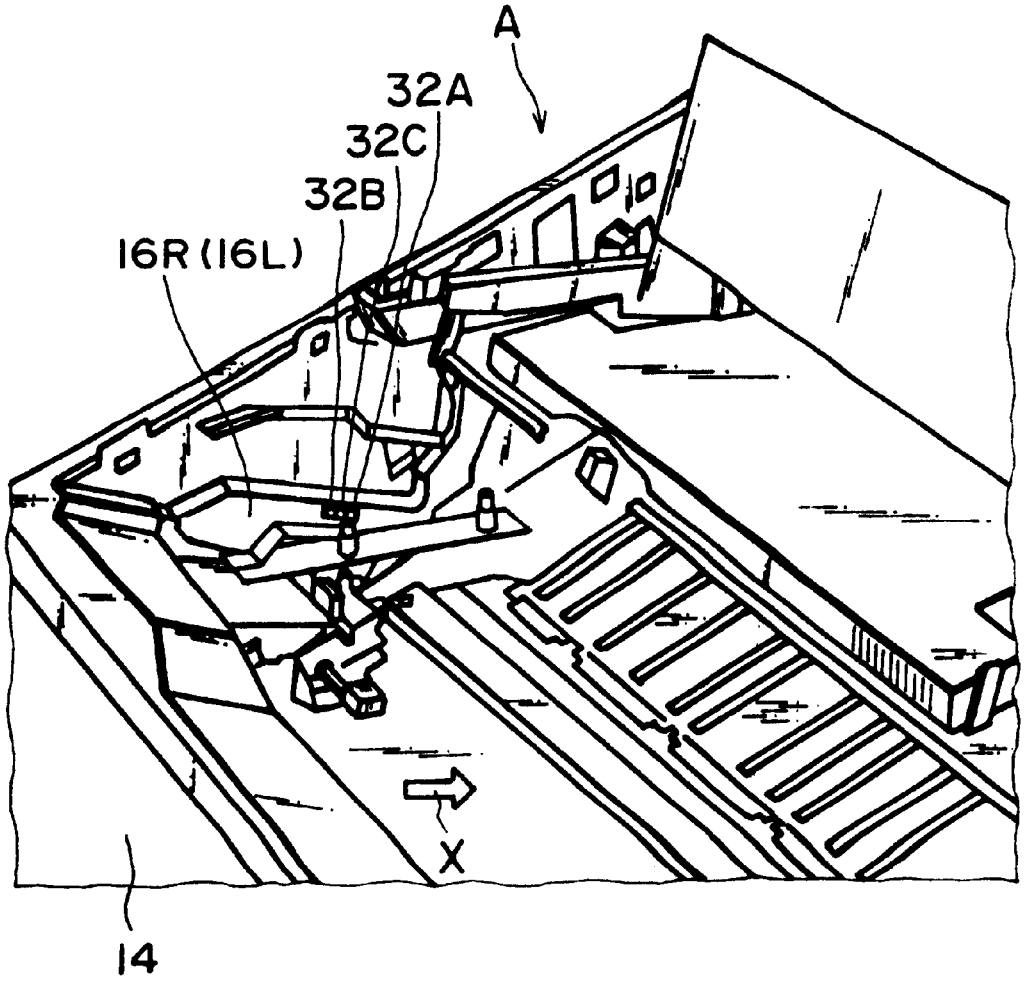
FIG. 5 is the perspective view of an outer appearance illustrating a mounting portion of a main assembly of an apparatus for mounting a process cartridge.

The process cartridge B is detachably mounted to cartridge mounting means of the main assembly 14 of the image forming apparatus by the user. In this embodiment, the cartridge mounting means comprises guide means 13R (13L) on the outer surface of the process cartridge B and guide portions 16R (16L) of the main assembly 14 of the apparatus for guiding the guide means 13R (13L), as shown in FIGS. 4 and 5.

According to the embodiment of the present invention, the process cartridge B is provided with a developer amount detecting device for detecting substantially real-time the remaining amount of the developer when the developer in the developer container 11A is consumed.

Figure 6:
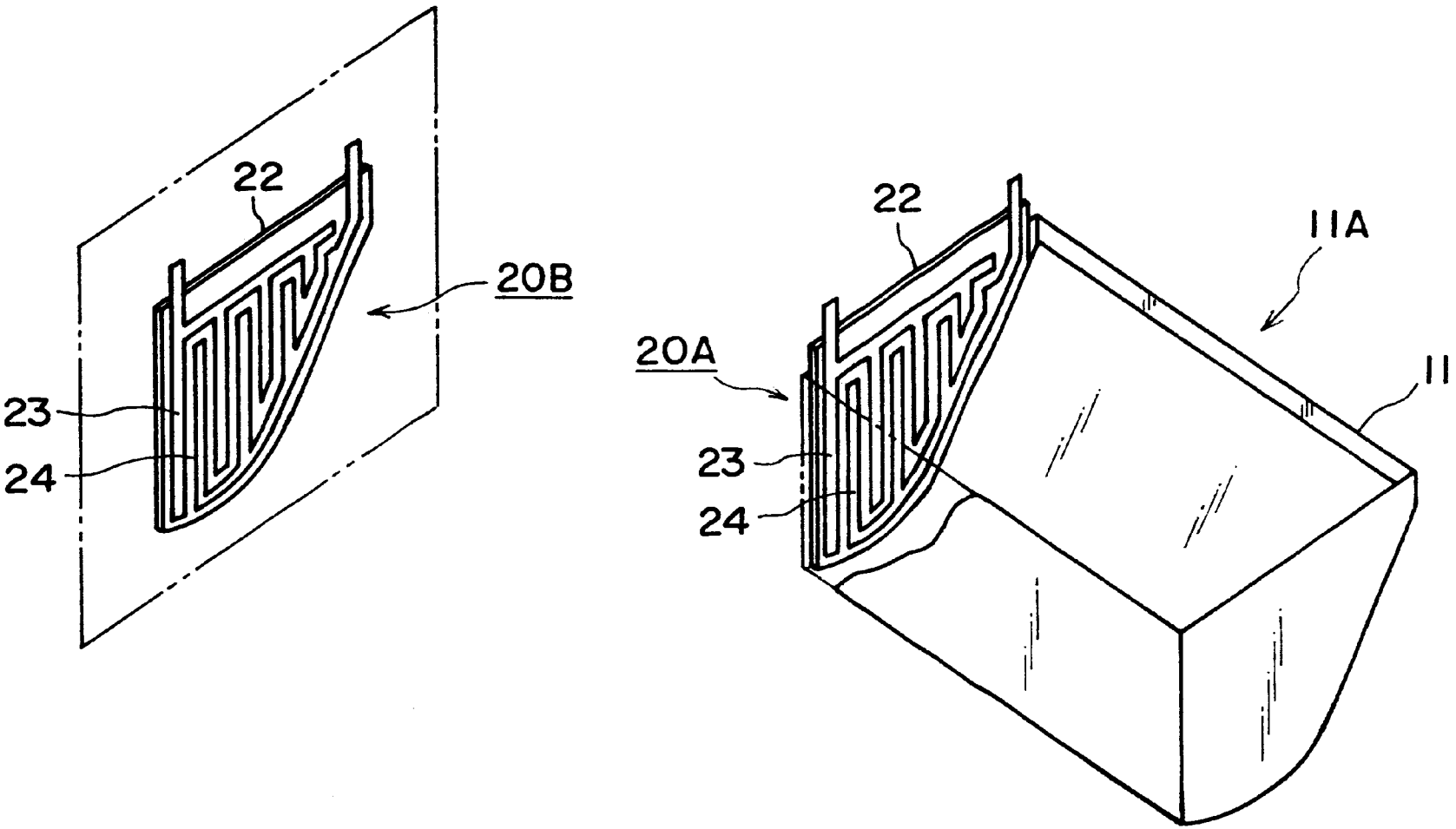
FIG. 6 is a perspective view of a developer container illustrating a description for a detecting device of an amount.

As shown in FIG. 6, the developer amount detecting device comprises a measuring electrode member 20A for detecting the amount of the developer, and a reference electrode member 20B for generating a reference signal on the basis of detection of the temperature and humidity of the ambiance.

Figure 13:
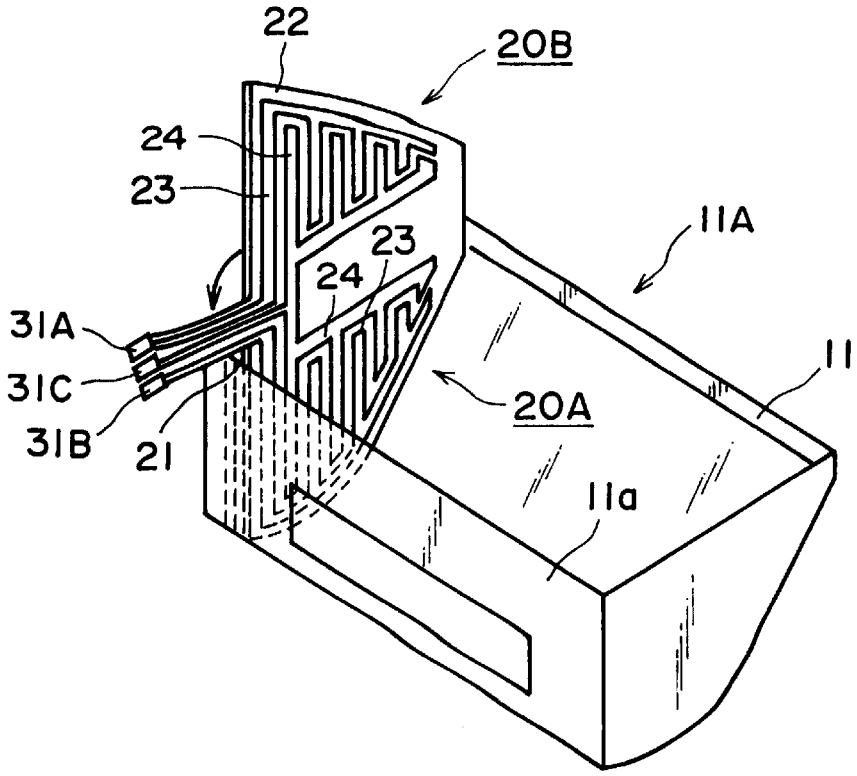
FIG. 13 is a perspective view of a developer container having a developer amount detecting device according to an embodiment of the present invention.
Figure 14:
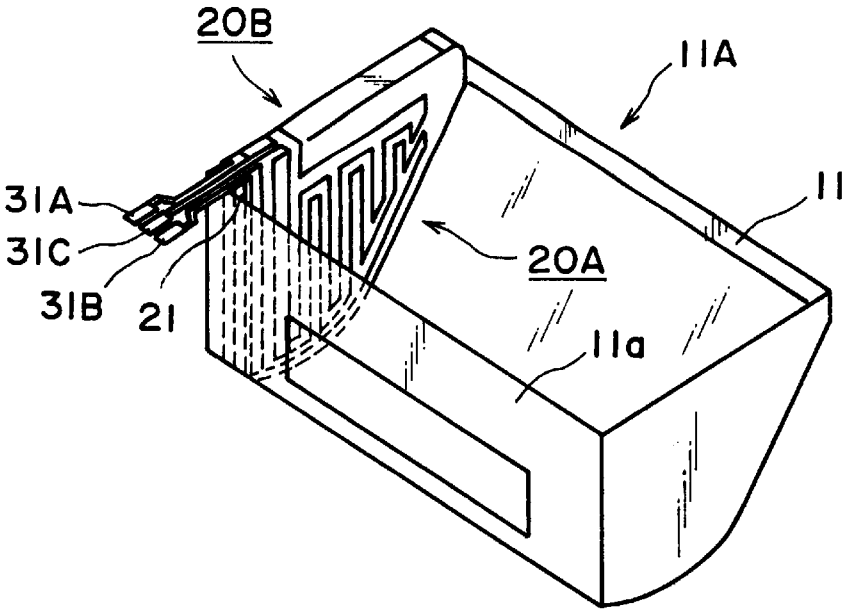
FIG. 14 is similar to FIG. 13, and is a perspective view of a developer container illustrating a developer container having a reference electrode member therein.

The measuring electrode member 20A is provided on an inside surface of the developer container 11A of the developing means 9 as shown in FIG. 6, or on such a portion in the developer container 11A that it contacts to the developer and that contact area thereof with the developer changes with a reduction of the developer, such as a bottom portion. As shown in FIGS. 13 and 14, the reference electrode member 20B may be disposed at such a position in the developer container as is the same side as the measuring electrode member 20A and is separated by a partition wall 21 so as not to be in contact with the developer.

Figure 7:
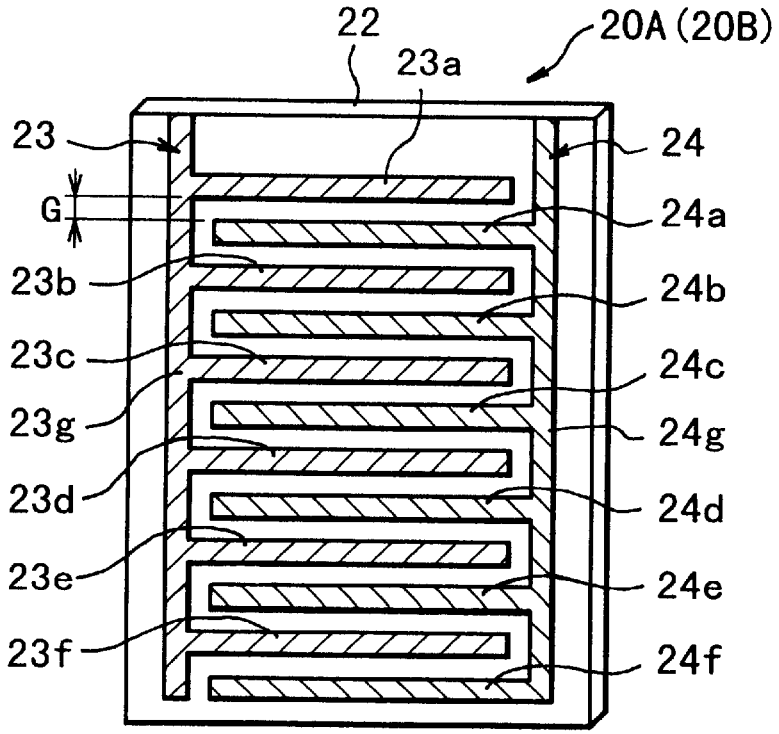
FIG. 7 is front views of a measuring electrode member and a reference electrode member according to an embodiment of the present invention.
Figure 8:
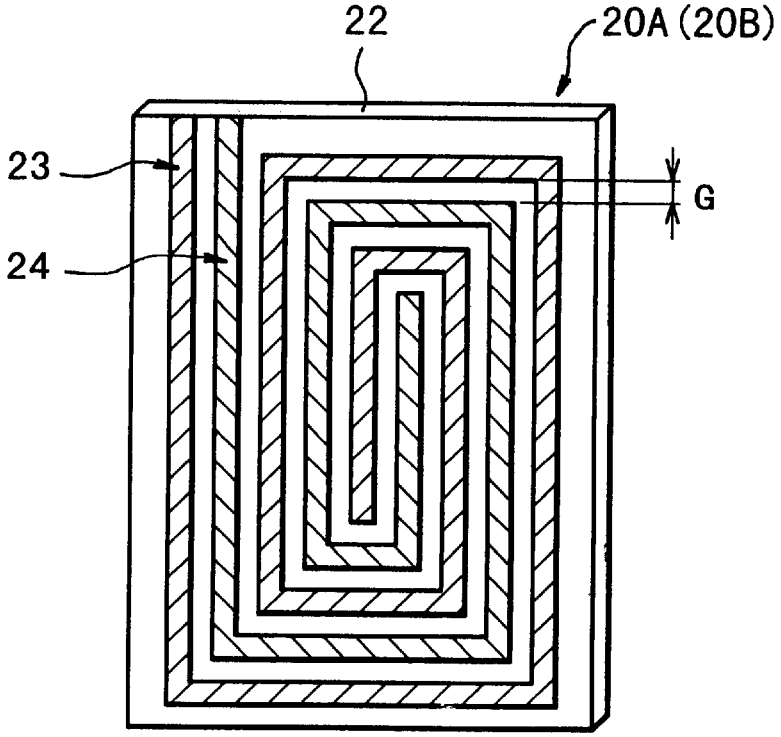
FIG. 8 is front views of a measuring electrode member and a reference electrode member according to another embodiment of the present invention.

As shown in FIG. 7, the measuring electrode member 20A comprises a pair of electroconductive portions (input-side electrode 23 and an output-side electrode 24) that are extended in parallel with each other with a predetermined gap on the substrate 22. In this embodiment, the electrodes 23, 24 have at least one pair of electrode portions 23*a*–23*f*, 24*a*–24*f* juxtaposed in parallel with a predetermined gap G, and the electrode portions 23*a*–23*f*, 24*a*–24*f* are connected to the connecting electrode portions 23*g*, 24*g*, respectively. Thus, the two electrodes 23 and 24 have a comb-like configuration with the branch portions interlaced with each other. However, the electrode pattern of the measuring electrode member 20A is not limited to those examples, and for example, as shown in FIG. 8, the electrodes 23, 24 may be extended in the volute pattern with constant gap.

The measuring electrode member 20A detects the remaining amount of the developer (the developer remainder) in the developer container 11A by detecting the electrostatic capacity between the parallel electrodes 23, 24. Since the developer has a dielectric constant which is larger than that of the air, the contact of the developer on the surface of the measuring electrode member 20A increases the electrostatic capacity between the electrodes 23, 24.

Therefore, according to this embodiment, the measuring electrode member 20A can detect the developer in the developer container 11A on the basis of the area of the developer contacting the surface of the measuring electrode member 20A, using a predetermined calibration curve, irrespective of the cross-sectional configuration of the developer container 11A or the configuration of the measuring electrode member 20A.

The electrode patterns 23, 24 of the measuring electrode member 20A can be provided by, for example, forming electroconductive metal patterns 23, 24 of copper or the like through etching or printing on a hard print board 22 such as paper phenol, glass epoxy resin or the like having a thickness of 0.4–1.6 mm or on a flexible printed board 22 of polyester, polyimide or the like resin material having a thickness of 0.1 mm. That is, they can be manufactured through the same manufacturing method as with ordinary printed boards and wiring patterns. Therefore, the complicated electrode pattern shown in FIGS. 7 and 8 can be easily manufactured at the same cost as with simple patterns.

When a complicated pattern shown in FIG. 7 or 8 is used, the length along which the electrodes 23, 234 are opposed to each other can be increased, and in addition, by using a pattern forming method such as etching, the gap between the electrodes 23, 24 can be reduced to several tens $\mu$m approximately, so that a large electrostatic capacity can be provided. The detection can be enhanced by increasing the amount of change of the electrostatic capacity. More particularly, the electrodes 23, 24 have a width of 0.1–0.5 mm, and a thickness of 17.5–70 $\mu$m with the gap G therebetween of 0.1–0.5 mm. The surface on which the metal pattern is formed can be laminated with a thin resin film having a thickness of 12.5–125 $\mu$m for example.

As described in the foregoing, according to the detecting device for the amount of the developer according to the present invention, the measuring electrode member 20A is disposed on the inner surface of the developer container 11A or on such an inner bottom surface that the contact area with a developer is reduced with the consumption of the developer, and the total amount of the developer in the developer container can be detected by the change of the electrostatic capacity of the measuring electrode member 20A, which change is indicative of the change of the contact area with the developer.

Since the dielectric constant of the developer is larger than that of the air, the electrostatic capacity is larger at the portion where the developer contacts the measuring electrode member 20A (where the developer exists) than at the portion where no developer is contacted thereto (where the developer does not exist). Therefore, the amount of the developer in the developer container 11A can be detected by detecting the change of the electrostatic capacity.

According to the present invention, the developer remainder detecting device, as shown in FIG. 6, further comprises the reference electrode member 20B having the similar structure as the measuring electrode member 20A.

The reference electrode member 20B has the same structure as the measurement electrode member 20A. More particularly, as shown in FIG. 7, it comprises a pair of electrodes (input-side electrodes 23(23*a*–23*f*) and output-side electrodes 24 (24*a*–24*f*)) formed parallel with a gap G on the substrate 22, and the two electrodes 23, 24 may be interlaced, or they may be in the form of a volute, as shown in FIG. 8. The reference electrode member 20B can be manufactured through the same manufacturing process as with the printed boards and the wiring patterns. According to this embodiment, the electrostatic capacity of the reference electrode member 20B changes in accordance with the ambient condition, such as the temperature and the humidity, as described hereinbefore, so that it functions as a calibration member (reference electrode or member) for the measuring electrode member 20A.

Thus, according to the detecting device for the amount of the developer of this embodiment, the output of the measuring electrode member 20A is compared with the output of the reference electrode member 20B, which is influenced by the change of the ambient conditions. For example, the electrostatic capacity of the reference electrode member 20B in a predetermined state is set to be the same as the electrostatic capacity of the measuring electrode member 20A when no developer exists, and then, the difference of the outputs of the reference electrode member 20B and the measuring electrode member 20A is indicative of the change of the electrostatic capacity caused by the presence of the developer, so that the accuracy of the detection of the remaining amount of the developer can be enhanced.

A description will be provided in more detail as to the detection principle of the amount of the developer. The measuring electrode member 20A detects the electrostatic capacity of the contact portion of the surface of the pattern to estimate the amount of the developer in the developer container 11A, and therefore, the output is influenced by a change of the ambiance (humidity, temperature or the like).

For example, when the humidity is high, which means that content of the moisture in the air is high, with the result that the dielectric constant of the atmospheric air contacting to the detecting member 20A is high. Therefore, even when the amount of the developer is the same, the output of the measuring electrode member 20A changes if the ambient condition changes. Additionally, if the material of the substrate 22 constituting the pattern absorbs moisture, the dielectric constant changes with the result, in effect, of the ambient conditions change.

By the use of the reference electrode member 20B, as the calibration element, which exhibits the same change as the measuring electrode member 20A in accordance with the ambient condition change, that is by the use of the reference electrode member 20B having the same structure as the measuring electrode member 20A but not contacting the developer, the reference electrode member 20B being placed under the same condition as the measuring electrode member 20A, the developer remainder can be detected without the influence of the ambient condition variation when the difference of the outputs of the measuring electrode member 20A and the reference electrode member 20B is used for the detection.

Figure 9:
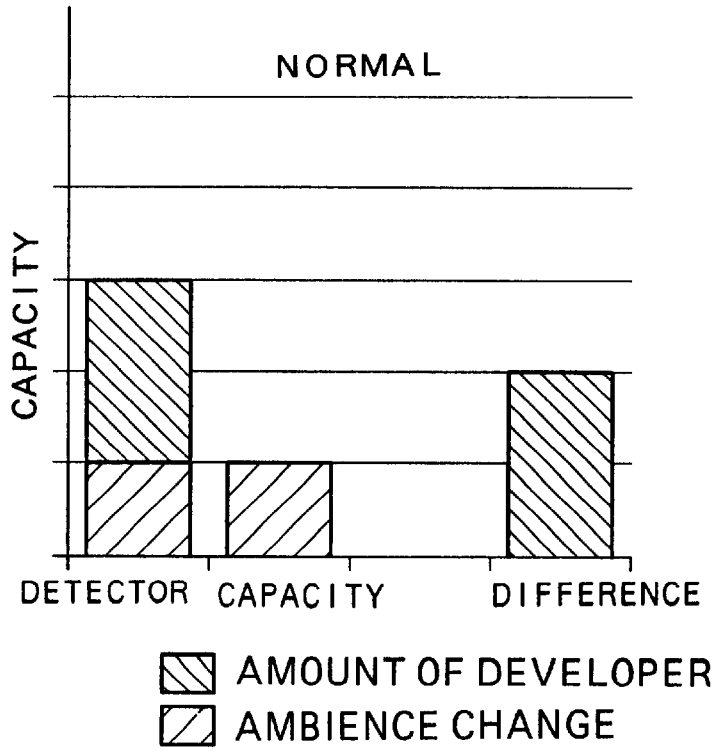
FIG. 9 is a graph explaining a detection principle of an amount of a developer.

As shown in the bar graph of FIG. 9, at the leftmost part, the electrostatic capacity determined by the measuring electrode member 20A for detecting the amount of the developer, is indicative of the variation of the developer contacting the surface of the detecting member plus the variation of the ambient condition. If the same is placed under a high temperature and high humidity ambience, the electrostatic capacity increases despite the fact that amount of the developer is the same, since the electrostatic capacity increases corresponding to the ambient condition change, as indicated at the leftmost part in FIG. 16.

Figure 10:
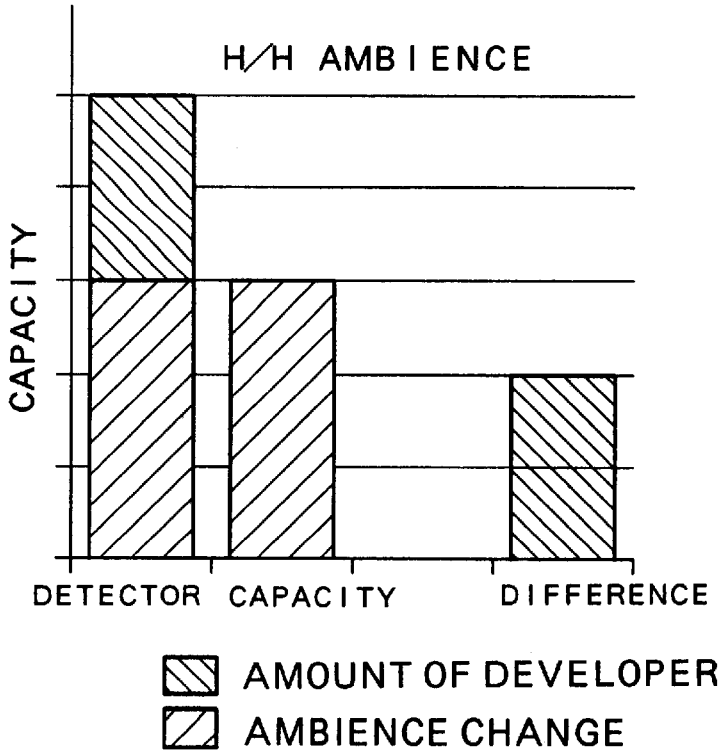
FIG. 10 is a graph explaining a detection principle for an amount of the developer according to an embodiment of the present invention.

As shown in the middle parts of FIGS. 9 and 10, the reference electrode member (calibration electrode) 20B exhibiting the same response to the ambient condition variation as the measuring electrode member (detecting member) 20A, is used, and the difference therebetween (right side of the graph) is taken, by which the electrostatic capacity indicative of the amount of the developer only, can be provided.

Figure 11:
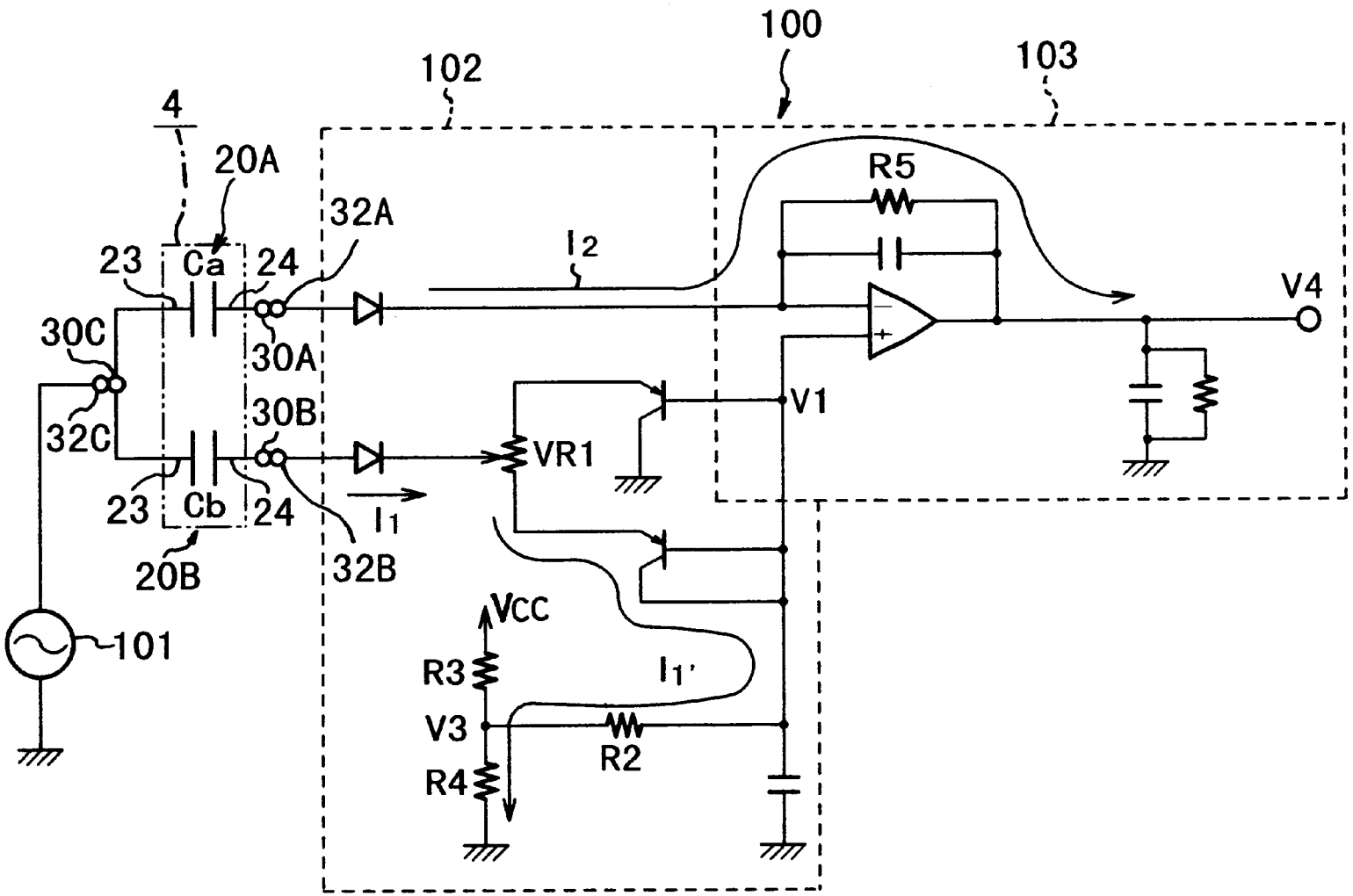
FIG. 11 shows a detecting circuit for an amount of the developer for detecting device for the amount of the developer according to an embodiment of the present invention.

Referring to FIG. 11, the detecting device for the amount of the developer embodying the above described principle will be described. FIG. 11 shows an example of a circuit for developer detection, more particularly, the connection between the measuring electrode member 20A and the reference electrode member 20B in the image forming apparatus.

The measuring electrode member 20A, as the detecting member having an electrostatic capacity Ca which changes in accordance with the amount of the developer, and the reference electrode member 20B, as a calibration for electrode having the electrostatic capacity Cb, which changes in accordance with the ambient condition, are connected as indicated; more particularly, the input-side electrodes 23 is connected to the developing bias circuit 101 (developing bias applying means) by way of a contact 30C (main assembly side contact 32C), and the output-side electrode 24 is connected to the control circuit 102 of developer amount detecting circuit 100 by way of contacts 30A (a main assembly side contact 32A) and 30B (main assembly side contact 32B). The reference electrode member 20B uses an AC (alternating) current $I_1$ supplied through a developing bias circuit 101, and a reference voltage V1 for detecting the setting of the developer remainder.

The control circuit 102, as shown in FIG. 11, adds, to the voltage V3 set by the resistances R3, R4, the voltage drop V2 determined by the resistance R2 and the AC current $I_1'$ which is the current branched by a volume VR1 from the AC current $I_1$ supplied to the reference electrode member 20B, that is, an impedance element.

The AC (alternating) current $I_2$ applied to the measuring electrode member 20A is inputted to the amplifier, and is outputted as the detected value V4 ($V1-I_2 \times R5$) indicative of the developer remainder. The voltage output is the detected value indicative of the developer remainder.

As described in the foregoing, according to the developer amount detecting device of this embodiment, the use is made of the reference electrode member 20B (calibration element) exhibiting the same capacity change in accordance with the ambient condition change as the measuring electrode member 20A, so that the detection error due to the variation of the ambient condition can be canceled or compensated for so that high accuracy of the detection for the developer remainder can be accomplished.

Figure 12:
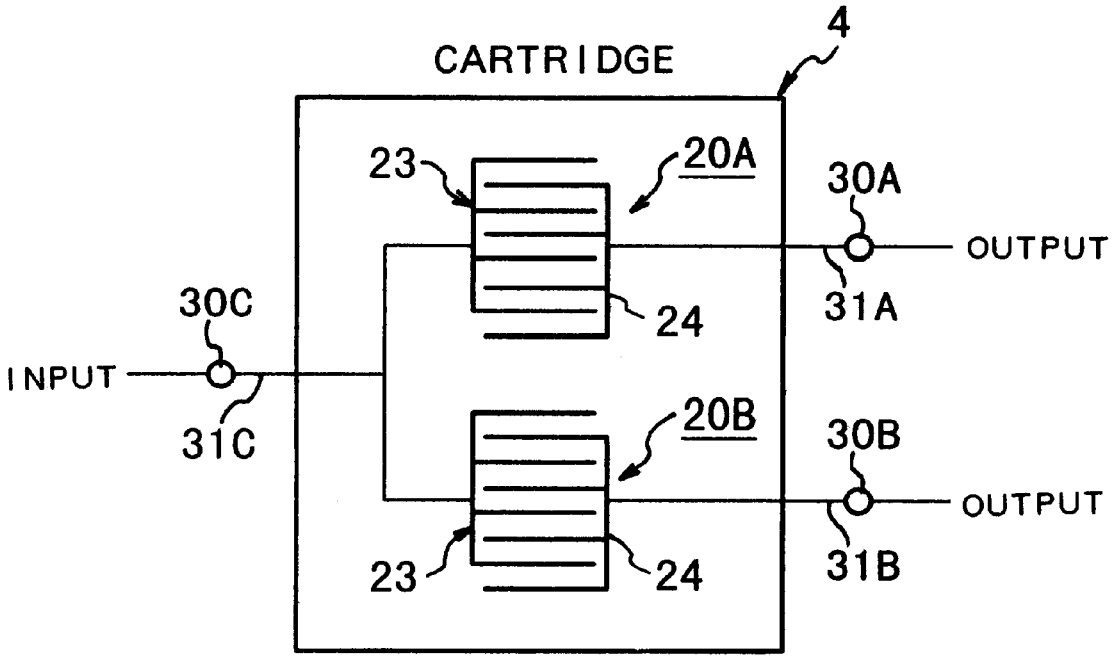
FIG. 12 is an illustration of arrangement of a measuring electrode member and a reference electrode member.

According to this embodiment, the reference electrode member 20B as the calibration member and the measuring electrode member 20A have the same structure and are disposed in the developer container 11A, as shown in FIGS. 12–14. With this structure, the developer container is provided both with the measuring electrode member 20A and the reference electrode member 20B, so that a variation due to the ambience can be removed or canceled, and since the measuring electrode member 20A and the reference electrode member can be placed under substantially the same ambient conditions, the detection accuracy can be enhanced.

Furthermore, according to this embodiment, as shown in FIGS. 11 and 12, the process cartridge B is provided with three contacts, namely, an input-side contact 30C, which is common for the detection and the comparison, and detection and comparison output contacts 30A and 30B. With such a structure, the number of contacts can be reduced. Additionally, by using common contacts for the input, the input pulse can be made identical, so that accuracy is enhanced.

According to this embodiment, as will be understood from FIGS. 13 and 14, the electrodes 23, 24 of the measuring electrode member 20A and the reference electrode member 20B are formed on one side of one bendable substrate 22, such as a flexible printed board, and is folded when it is mounted to the developer container. In this embodiment, the measuring electrode member 20A and the reference electrode member 20B have the same electrode pattern. Therefore, the patterns of the electrodes 23, 24 of the measuring electrode member 20A and the reference electrode member 20B provide substantially the same electrostatic capacities, and the width, the length, the clearance and the opposing areas are substantially the same. The reference electrode member 20B thus manufactured is folded back substantially at the center of the substrate, and it is disposed at such a position in the developer container 11A containing the measuring electrode member that it is partitioned by a partition wall 21 and it is not contacted to the developer.

The measuring electrode member 20A and the reference electrode member 20B are manufactured in a similar manner to the normal manufacturing step of the printed boards, and therefore, there are variations in the electrostatic capacities of the substrates due to the variations in the width, the height of the electrode pattern, resulting from the variation of the moisture absorbed rate and/or the dielectric constant of the equipment or material, and/or the etching conditions. According to this embodiment, the measuring electrode member 20A and the reference electrode member 20B are formed on the same side of the substrate, so that a single substrate is used both for the detecting member and the calibration member, and therefore, the cost can be reduced. Additionally, the electrode patterns are formed on the same material, and the variations attributable to the differences of the natures of the base material can be minimized. Moreover, since the patterns are formed on the same side of the base material, the variations during the pattern formation, such as during the etching, can be suppressed. Furthermore, with such a structure, the detection pattern can be provided toward the top of the developer container, so that detection of the developer is possible even if the developer container is full to the top. According to this embodiment, as shown in FIG. 13, from the substrate 22 on which the measuring electrode member 20A and the reference electrode member 20B are formed, there are projected the output contact 31A for the measuring electrode connected electrically with the output-side electrode 24 of the measuring electrode member 20A, the output contact 31B for the reference electrode connected electrically with the output-side electrode 24 of the reference electrode member 20B, and the common input contact 31C connected with the input-side electrodes 23 of the measuring electrode member 20A and the reference electrode member 20B.

Figure 15:
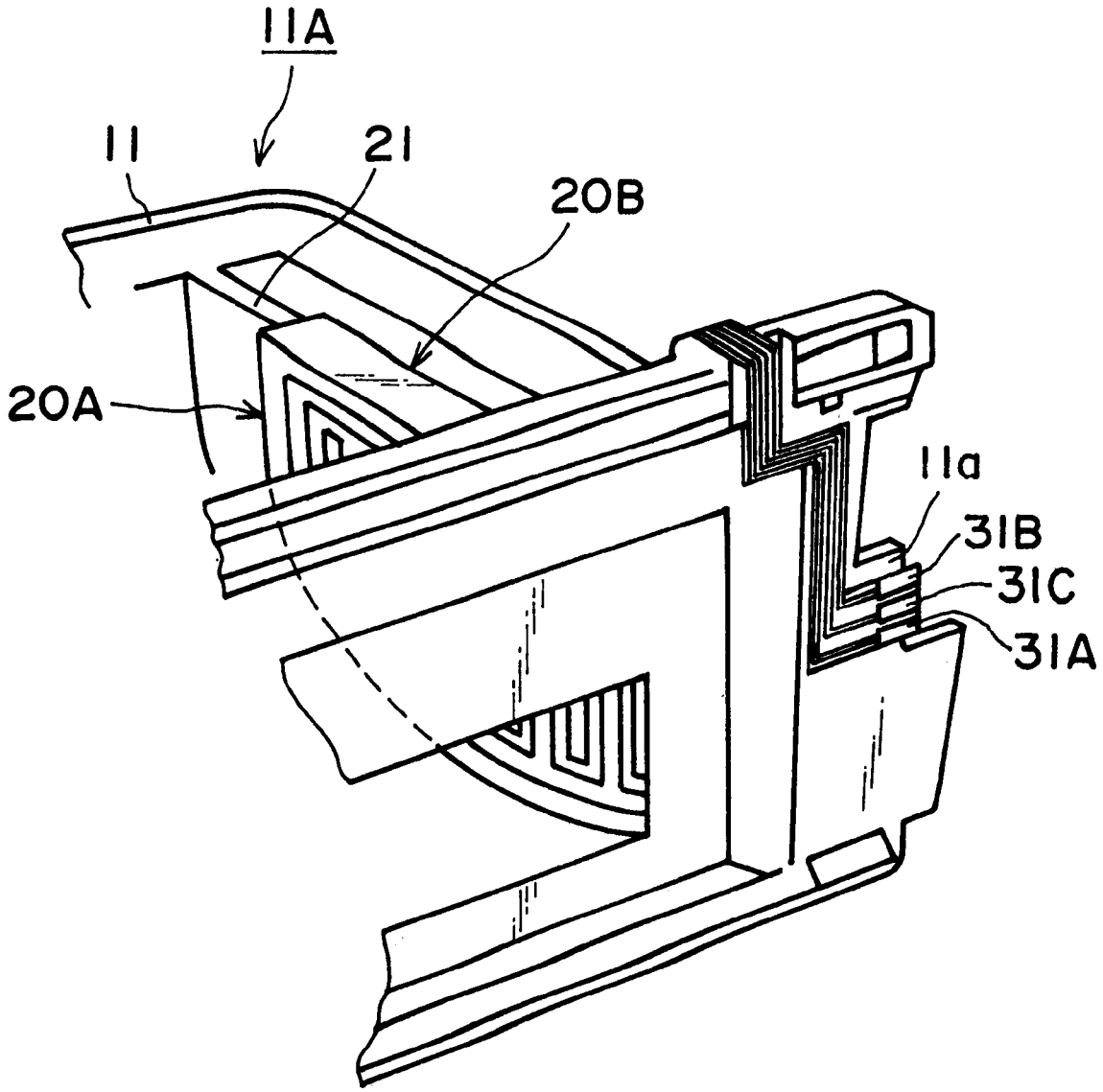
FIG. 15 is an illustration of connection of contacts of a measuring electrode member and a reference electrode member.
Figure 16:
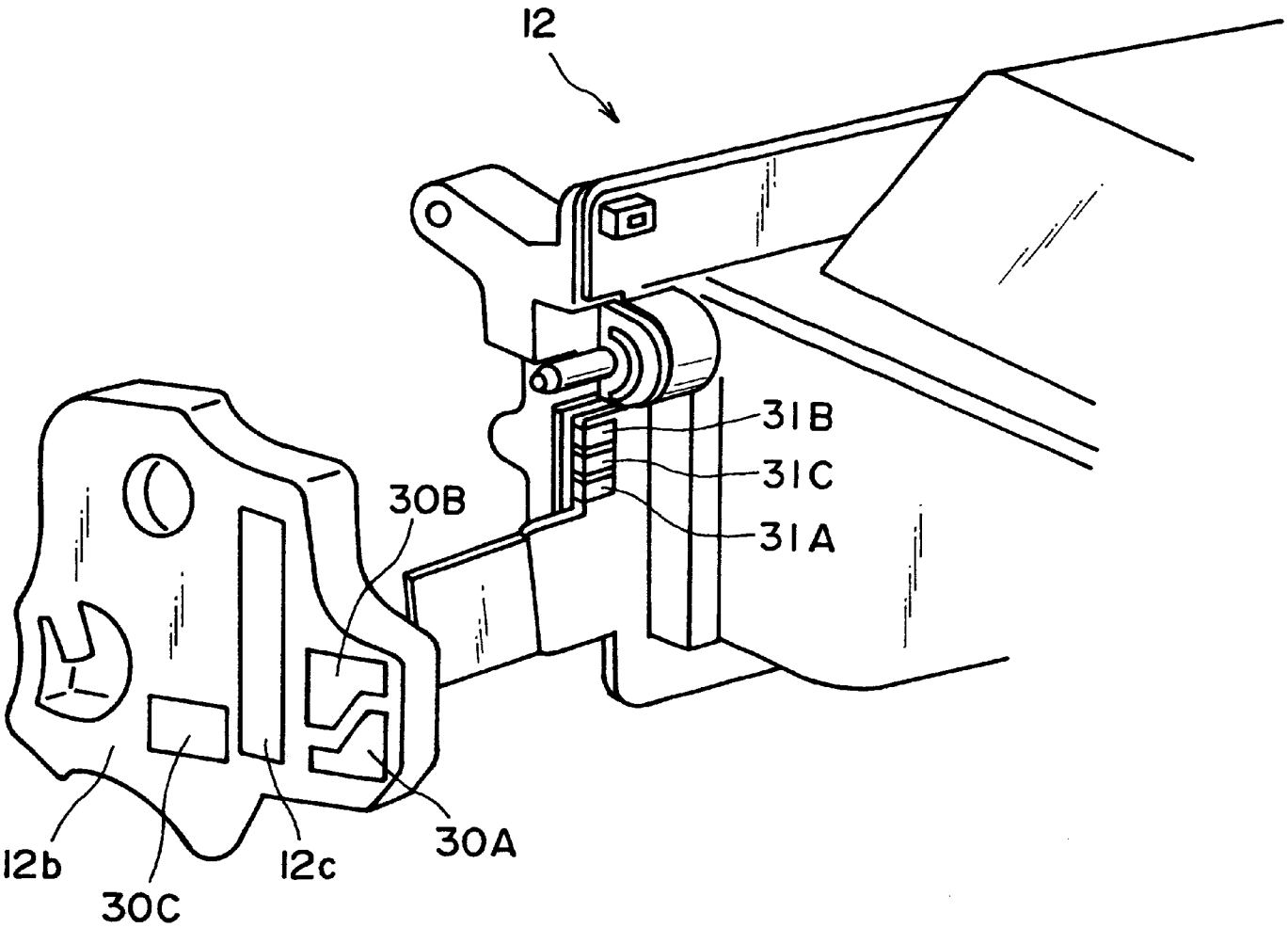
FIG. 16 is an illustration of 3 contacts provided in a process cartridge.

These three contacts 31A, 31B, 31C, are fixed to a front wall portion 11*a* of the developer frame 11 bridging the weld portion relative to the developing device frame 12 FIG. 16) of the developer container 11A as shown in FIG. 15; and the three contacts 31A, 31B, 31C are exposed outwardly from the contact port 12*c* formed in the side member 12*b* fixed to the side of the developing device frame 12, as shown in FIGS. 16 and 4 and are connected electrically to the output contact 30A of the measuring electrode and to the output contact 30B of the common input contact 30C mounted to the side member 12*b*. As shown in FIG. 5, the contacts 30A, 30B, 30C of the process cartridge are electrically connected to the contacts 32A, 32B, 32C in the main assembly 14 of the apparatus when the process cartridge B is mounted to the main assembly 14 of the apparatus, and therefore, the measuring electrode member 20A and the reference electrode member 20B provided in the process cartridge B are connected to the developer amount measuring circuit 100 shown in FIG. 11.

In the foregoing description of the embodiment, the patterns of the electrodes 23, 24 of the reference electrode member 20B and the measuring electrode member 20A have substantially the same electrostatic capacities, pattern widths, lengths, clearances and opposing areas. However, the areas of the electrode patterns 23, 24 of the reference electrode member 20B for calibration may be different from that of the electrode patterns 23, 24 of the measuring electrode member 20A. In this case, the output of the reference electrode member 20B is multiplied by a predetermined coefficient, and the multiplied output is compared with the output of the measuring electrode member 20A. Using such a structure, the size of the reference electrode member 20B can be reduced so that space occupied by the detecting member can be reduced. The members 20A and 20B may be placed on the same wall of the developer container 11A at the same side, and the reference electrode member 20B is prohibited from contacting the developer, and in this case, it is possible to increase the percentage of the pattern area of the detecting member 20A in the limited the area, therefore, the amount of the change of the electrostatic capacity and the detection accuracy can be enhanced.

In the foregoing, the same configurations or same dimensions do not mean exactly identical configuration or dimensions, and do not exclude those having a difference due to manufacturing errors or the like, as long as the detection can be made with practical accuracy.

As described in the foregoing, according to this embodiment, the developer container 11A is provided with the measuring electrode member 20A and the reference electrode member 20B for substantially real-time detection of the developer remainder, further preferably, the developer chamber 9A of the developing means 9 is provided with an antenna rod, that is, an electrode rod 9*h* FIG. 3 is extended by a predetermined length in the longitudinal direction of the developing roller 9*a* with a predetermined clearance from the developing roller 9*a*. With this structure, the emptiness of the developer in the developer container can be detected by detecting the change of the electrostatic capacity between the developing roller 9*a* and the electrode rod 9*h*.

According to the image forming apparatus of this embodiment, the amount of the developer in the developer container 11A can be detected substantially in real-time, and on the basis of the detection, the consumption amount of the developer may be displayed so as to influence the user to prepare the replenishing cartridge and further to supply the developer upon the display of the emptiness.

Figure 17:
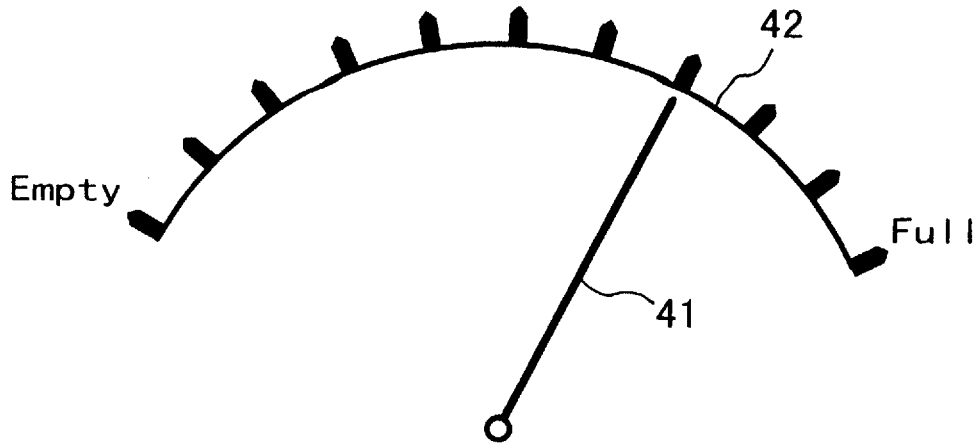
FIG. 17 is an illustration of display of an amount of the developer according to an embodiment of the present dimension.
Figure 18:
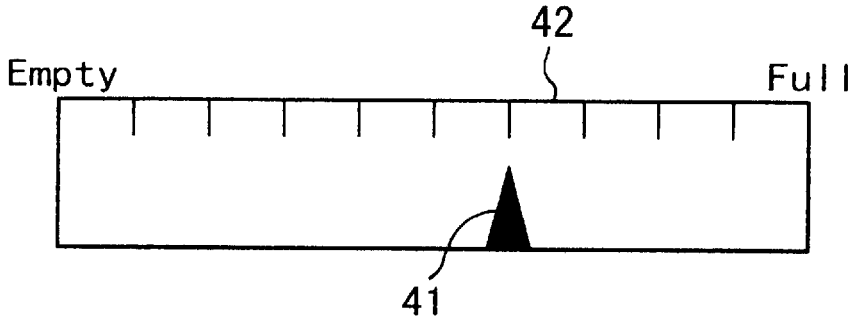
FIG. 18 shows a further example of display of an amount of the developer according to an embodiment of the present invention.

A description will be provided as to the manner of display of the amount of the developer. The detected information provided by the developer amount detecting device is displayed on the screen of the terminal equipment, such as a personal computer of the user in the manner, shown in FIGS. 20 and 18. In FIGS. 17 and 18, an indicator 41 moves in accordance with the amount of the developer so that the user is aware of the amount of the developer.

Figure 19:
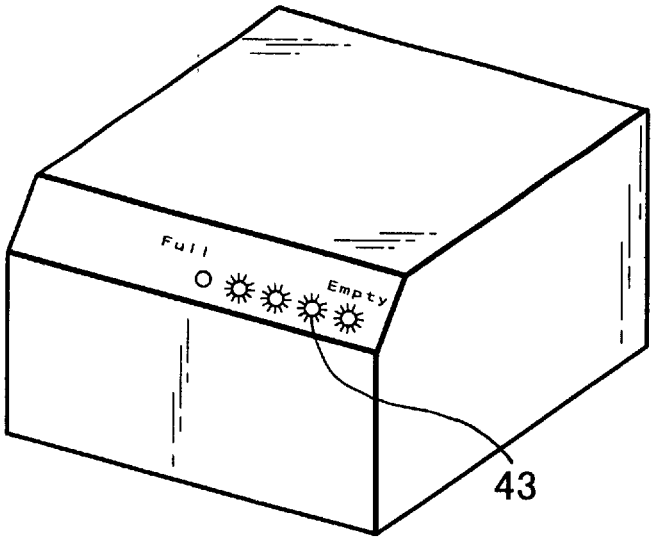
FIG. 19 shows a further example of display of an amount of the developer according to an embodiment of the present invention.

FIG. 19 shows an alternative, wherein the main assembly of the electrophotographic image forming apparatus is provided with a display portion of, LED (43) or the like, which is lit on or off, in accordance with the amount of the developer.

According to an aspect of the present invention, the measuring electrode member is disposed in a developer accommodating portion for accommodating the developer to be used for development of an electrostatic latent image by developing means as the process means, and the position of the measuring electrode member is such that it contacts the developer in the developer accommodating portion, and the position of the reference electrode member is such that it is out of contact with the developer in the developer accommodating portion.

According to another aspect of the present invention, the measuring electrode member and the reference electrode member are manufactured by forming electrode patterns on the same side of one substrate, and preferably the measuring electrode member and the reference electrode member generate substantially the same electrostatic capacity when a voltage is applied thereto. According to a further aspect of the present invention, a length of an opposed portion of the juxtaposed portions and a gap therebetween in the measuring electrode member are substantially the same as those of the reference electrode member, respectively.

According to a further aspect of the present invention, the developing means has an electrode rod for detecting substantial absence of the developer.

As described in the foregoing, the present invention provides the following advantages:

(1) The remaining amount of the developer in the developer accommodating portion can be detected substantially real-time in accordance with consumption of the developer:

(2) The detection in (1) can be effected with minimum measurement error which may otherwise results due to the change of the ambient conditions.

(3) The number of parts of the contact portions can be reduced, and therefore, the manufacturing cost can be reduced.

(4) The assembling operativity of the developing device and/or the process cartridge can be improved.

In the foregoing embodiments, the range of substantially real-time detection of the remaining amount of the developer is not limited to the full range, that is, the range of 100% (Full) –0% (Empty). The substantially real-time detection range may be properly determined by one skilled in the art, for example, the range of, 100%–25%, or, 30%–0%, or the like. The remaining amount of 0% does not necessarily mean that there exists no developer at all. The remaining amount of 0% may be indicative of the event that developer has decreased to such an extent that predetermined image quality is not provided.

As described, the present invention can accomplish the detection of the amount of the developer substantially in real-time. Furthermore, the present invention can reduce the number of parts.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an electrophotographic image forming apparatus, said process cartridge comprising:

(a) an electrophotographic photosensitive member;

(b) process means actable on said electrophotographic photosensitive member;

(c) a measuring electrode member having input side and output side electrodes having at least one juxtaposed portion, said measuring electrode member being disposed at such a position that it is contacted to a developer;

(d) a reference electrode member having input side and output side electrodes having at least one juxtaposed portion, said reference electrode member being disposed at such a position that it is out of contact with the developer;

(e) an output contact for said measuring electrode member, connected electrically to said output side electrode of said measuring electrode member;

(f) an output contact for said reference electrode member, connected electrically to said output side electrode of said reference electrode member; and (g) a common input contact connected electrically to said input side electrodes of said measuring electrode member and said reference electrode member.

2. A process cartridge according to claim 1, wherein said measuring electrode member is disposed in a developer accommodating portion for accommodating the developer to be used for development of an electrostatic latent image by developing means as said process means, and the position of said measuring electrode member is such that it is contacted to the developer in said developer accommodating portion.

3. A process cartridge according to claim 1 or 2, wherein said reference electrode member is disposed in a developer accommodating portion for accommodating the developer to be used for development of an electrostatic latent image by developing means as said process means, and the position of said reference electrode member is such that it is out of contact with the developer in said developer accommodating portion.

4. A process cartridge according to claim 1 or 2, wherein said measuring electrode member and said reference electrode member are manufactured by forming electrode patterns on the same side of one substrate.

5. A process cartridge according to claim 4, wherein said measuring electrode member and said reference electrode member generate substantially the same electrostatic capacity when a voltage is applied thereto without the developer.

6. A process cartridge according to claim 4, wherein a length of an opposed portion of said juxtaposed portions and a gap therebetween in said measuring electrode member are substantially the same as those of said reference electrode member, respectively.

7. A process cartridge according to any one of claim 2 or 3, wherein said developing means has an electrode rod for detecting substantial absence of the developer.

8. A process cartridge according to claim 1, wherein said process cartridge contains as a unit said electrophotographic photosensitive member, and at least one of charging means, developing means and cleaning means as said process means.

9. A process cartridge according to any one of claim 1, wherein said process cartridge contains as a unit said electrophotographic photosensitive member, and developing means as said process means.

10. An electrophotographic image forming apparatus for forming an image on a recording material, to which apparatus a process cartridge is detachably mountable, comprising:

(a) mounting means for detachably mounting the process cartridge to the main assembly of the electrophotographic image forming apparatus, the process cartridge including:
an electrophotographic photosensitive member;
process means actable on said electrophotographic photosensitive member;
a measuring electrode member having input side and output side electrodes having at least one juxtaposed portion, said measuring electrode member being disposed at such a position that it is contacted to a developer;
a reference electrode member having input side and output side electrodes having at least one juxtaposed portion, said reference electrode member being disposed at such a position that it is out of contact with the developer;
an output contact for said measuring electrode member, connected electrically to said output side electrode of said measuring electrode member;
an output contact for said reference electrode member, connected electrically to said output side electrode of said reference electrode member; and
a common input contact connected electrically to said input side electrodes of said measuring electrode member and said reference electrode member;

(b) display means for displaying an amount of the developer determined on the basis of outputs from said output contact for said measuring electrode member and said output contact for said reference electrode member; and (c) feeding means for feeding said recording material.

11. An apparatus according to claim 10, wherein said measuring electrode member is disposed in a developer accommodating portion for accommodating the developer to be used for development of an electrostatic latent image by developing means as said process means, and the position of said measuring electrode member is such that it is contacted to the developer in said developer accommodating portion.

12. An apparatus according to claim 10 or 11, wherein said reference electrode member is disposed in a developer accommodating portion for accommodating the developer to be used for development of an electrostatic latent image by developing means as said process means, and the position of said reference electrodes member is such that it is out of contact with the developer in said developer accommodating portion.

13. An apparatus according to claim 10 or 11, wherein said measuring electrode member and said reference electrode member are manufactured by forming electrode patterns on the same side of one substrate.

14. An apparatus according to claim 13, wherein said measuring electrode member and said reference electrode member generate substantially the same electrostatic capacity when a voltage is applied thereto without contact with the developer.

15. An apparatus according to claim 13, wherein a length of an opposed portion of said juxtaposed portions and a gap therebetween in said measuring electrode member are substantially the same as those of said reference electrode member, respectively.

16. An apparatus according to any one of claim 11 or 12, wherein said developing means has an electrode rod for detecting substantial absence of the developer.

17. An apparatus according to any one of claim 10, wherein said process cartridge contains as a unit said electrophotographic photosensitive member, and at least one of charging means, developing means and cleaning means as said process means.

18. An apparatus according to any one of claim 10, wherein said process cartridge contains as a unit said electrophotographic photosensitive member, and developing means as said process means.

19. A developing device for being provided in a main assembly of an electrophotographic image forming apparatus comprising:

(a) a developer accommodating portion for accommodating a developer to be used for developing an electrostatic latent image formed on an electrophotographic photosensitive member;

(b) developing means for developing an electrostatic latent image with the developer accommodating in said developer accommodating portion;

(c) a measuring electrode member having input side and output side electrodes having at least one juxtaposed portion, said measuring electrode member being disposed at such a position that it is contacted to a developer;

(d) a reference electrode member having input side and output side electrodes having at least one juxtaposed portion, said reference electrode member being disposed at such a position that it is out of contact to the developer;

(e) an output contact for said measuring electrode member, connected electrically to said output side electrode of said measuring electrode member;

(f) an output contact for said reference electrode member, connected electrically to said output side electrode of said reference electrode member; and (g) a common input contact connected electrically to said input side electrodes of said measuring electrode member and said reference electrode member.

20. A device according to claim 19, wherein the position of said measuring electrode member is such that it is contacted to the developer in said developer accommodating portion.

21. A device according to claim 19, wherein the position of said reference electrode member is such that it is out of contact to the developer in said developer accommodating portion.

22. An device according to claim 19 or 20, wherein said measuring electrode member and said reference electrode member are manufactured by forming electrode patterns on the same side of one substrate.

23. A device according to claim 22, wherein said measuring electrode member and said reference electrode member generate substantially the same electrostatic capacity when a voltage is applied thereto without contact with the developer.

24. A device according to claim 19 or 22, wherein a length of an opposed portion of said juxtaposed portions and a gap therebetween in said measuring electrode member are substantially the same as those of said reference electrode member, respectively.

25. A device according to claim 19, wherein said developing means has an electrode rod for detecting substantial absence of the developer.

26. An electrophotographic image forming apparatus for forming an image on a recording material, said electrophotographic image forming apparatus comprising:

an electrophotographic photosensitive member;

developing means for developing with a developer an electrostatic latent image formed on said electrophotographic photosensitive member;

a measuring electrode member having input side and output side electrodes having at least one juxtaposed portion, said measuring electrode member being disposed at such a position that it is contacted to a developer;

a reference electrode member having input side and output side electrodes having at least one juxtaposed portion, said reference electrode member being disposed at such a position that it is out of contact to the developer;

an output contact for said measuring electrode member, connected electrically to said output side electrode of said measuring electrode member;

an output contact for said reference electrode member, connected electrically to said output side electrode of said reference electrode member; and a common input contact connected electrically to said input side electrodes of said measuring electrode member and said reference electrode member;

display means for displaying an amount of the developer determined on the basis of outputs from said output contact for said measuring electrode member and said output contact for said reference electrode member; and electrostatic latent image forming means for forming the electrostatic latent image on said electrophotographic photosensitive member.

27. An apparatus according to claim 26, wherein said measuring electrode member is disposed in a developer accommodating portion for accommodating the developer to be used for development of an electrostatic latent image by said developing means, and the position of said measuring electrode member is such that it is contacted to the developer in said developer accommodating portion.

28. An apparatus according to claim 27, wherein said reference electrode member is disposed in a developer accommodating portion for accommodating the developer to be used for development of an electrostatic latent image by said developing means, and the position of said reference electrode member is such that it is out of contact to the developer in said developer accommodating portion.

29. An apparatus according to claim 27 or 28, wherein said measuring electrode member and said reference electrode member are manufactured by forming electrode patterns on the same side of one substrate.

30. An apparatus according to claim 29, wherein said measuring electrode member and said reference electrode member generate substantially the same electrostatic capacity when a voltage is applied thereto without contact with the developer.

31. An apparatus according to claim 26 or 29, wherein a length of an opposed portion of said juxtaposed portions and a gap there between in said measuring electrode member are substantially the same as those of said reference electrode member, respectively.

32. An apparatus according to any one of claim 26, wherein said developing means has an electrode rod for detecting substantial absence of the developer.

33. A measuring part for detecting an amount of a developer, comprising:

(a) a measuring electrode member having input side and output side electrodes having at least one juxtaposed portion;

(b) a reference electrode member having input side and output side electrodes having at least one juxtaposed portion;

(c) an output contact for said measuring electrode member, connected electrically to said output side electrode of said measuring electrode member;

(d) an output contact for said reference electrode member, connected electrically to said output side electrode of said reference electrode member; and (e) a common input contact connected electrically to said input side electrodes of said measuring electrode member and said reference electrode member.

34. A measuring part according to claim 33, wherein said measuring electrode member is disposed in a developer accommodating portion for accommodating the developer to be used for development of an electrostatic latent image by developing means, and the position of said measuring electrode member is such that it is contacted to the developer in said developer accommodating portion.

35. A measuring part according to claim 33 or 34, wherein said reference electrode member is disposed in a developer accommodating portion for accommodating the developer to be used for development of an electrostatic latent image by developing means, and the position of said reference electrode member is such that it is out of contact with the developer in said developer accommodating portion.

36. A measuring part according to claim 33 or 34, wherein said measuring electrode member and said reference electrode member are manufactured by forming electrode patterns on the same side of one substrate.

37. A measuring part according to claim 36, wherein said measuring electrode member and said reference electrode member generate substantially the same electrostatic capacity when a voltage is applied thereto without contact with the developer.

38. A measuring part according to claim 36, wherein a length of an opposed portion of said juxtaposed portions and a gap therebetween in said measuring electrode member are substantially the same as those of said reference electrode member, respectively.

39. A measuring part according to any one of claim 35, wherein said developing means has an electrode rod for detecting substantial absence of the developer.

40. A process cartridge according to claim 1, wherein said juxtaposed portions of said measuring electrode member are arranged at regular intervals.

41. A process cartridge according to claim 1 or 40, wherein said juxtaposed portions of said reference electrode member are arranged at regular intervals.

42. An apparatus according to claim 10 or 26, wherein said juxtaposed portions of said measuring electrode member are arranged at regular intervals.

43. An apparatus according to claim 10 or 26, wherein said juxtaposed portions of said reference electrode member are arranged at regular intervals.

44. A device according to claim 19, wherein said juxtaposed portions of said measuring electrode member are arranged at regular intervals.

45. A device according to claim 19 or 44, wherein said juxtaposed portions of said reference electrode member are arranged at regular intervals.

46. A device according to claim 33, wherein said juxtaposed portions of said measuring electrode member are arranged at regular intervals.

47. A device according to claim 33 or 46, wherein said juxtaposed portions of said reference electrode member are arranged at regular intervals.

48. A process cartridge detachably mountable to a main assembly of an electrophotographic image forming apparatus, said process cartridge comprising:

(a) an electrophotographic photosensitive member;

(b) a developing roller for developing a latent image formed on said electrophotographic photosensitive member;

(c) a measuring electrode member having input-side and output-side electrodes, said measuring electrode member being disposed at such a position that it is contacted to a developer accommodated in said process cartridge;

(d) a reference electrode member having input-side and output-side electrodes, said reference electrode member being disposed at such a position that it is out of contact with the developer accommodated in said process cartridge;

(e) an output contact for said measuring electrode member, connected electrically to said output side electrode of said measuring electrode member;

(f) an output contact for said reference electrode member, connected electrically to said output-side electrode of said reference electrode member; and (g) a common input contact connected electrically to said input side electrodes of said measuring electrode member and said reference electrode member, wherein said output contact for said measuring electrode member, said output contact for said reference electrode member and said common input contact are provided exposed on said cartridge frame, and an amount of the developer in said process cartridge is capable of being detected by said main assembly using outputs, corresponding to electrostatic capacities from said output contact for said measuring electrode member and from said output contact for said reference electrode member.

49. A process cartridge according to claim 48, wherein said measuring electrode member is disposed in a developer accommodating portion for accommodating the developer to be used for development of an electrostatic latent image by said developing means, and the position of said measuring electrode member is such that it is contacted to the developer in said developer accommodating portion.

50. A process cartridge according to claim 48 or 49, wherein said reference electrode member is disposed in a developer accommodating portion for accommodating the developer to be used for development of an electrostatic latent image by a developing roller, and the position of said reference electrode member is such that it is out of contact with the developer in said developer accommodating portion.

51. A process cartridge according to claim 49, wherein said measuring electrode member and said reference electrode member are manufactured by forming electrode patterns on the same side of one substrate, wherein said substrate is folded substantially at its center, and said reference electrode member is disposed in said developer accommodating portion, in which said measuring electrode is disposed, so as to avoid contact with the developer by a partition wall.

52. A process cartridge according to claim 51, wherein said measuring electrode member and said reference electrode member generate substantially the same electrostatic capacity when a voltage is applied thereto.

53. A process cartridge according to claim 51, wherein said measuring electrode member has at least one juxtaposed portion, and said reference electrode member has at least one juxtaposed portion, and a length of an opposed portion of said juxtaposed portions and a gap therebetween in said measuring electrode member are substantially the same as those of said reference electrode member, respectively.

54. A process cartridge according to any one of claims 48, 49, 51, 52, or 53, further comprising an electrode rod, extended in a longitudinal direction of said developing roller, for detecting substantial absence of the developer.

55. A process cartridge according to claim 48, wherein said process cartridge frame includes a side frame provided at longitudinal end of said developing frame supporting said developing roller.

56. A process cartridge according to claim 1 or 48, wherein said measuring electrode member is positioned for contact to the developer and is oriented such that an area in which said measuring electrode member is contacted to the developer changes with a reduction of the developer.

57. A device according to claim 19, wherein said measuring electrode member is positioned for contact to the developer and is oriented such that an area in which said measuring electrode member is contacted to the developer changes with a reduction of the developer.

* * * * *

UNITED STATES PATENT AND TRADEMARK OFFICE

CERTIFICATE OF CORRECTION

PATENT NO. : 6,253,036 B1
DATED : June 26, 2001
INVENTOR(S) : Toshiyuki Karakama et al.

It is certified that error appears in the above-identified patent and that said Letters Patent is hereby corrected as shown below:

Title page,
Item [57], ABSTRACT,
Line 7, "portions," should read -- portion, --.

Column 1,
Line 51, "developer detection" should read -- developer-detection --.

Column 2,
Line 55, "said" should read -- the --.

Column 3,
Line 4, "input side" should read -- input-side --.
Line 45, "for" should read -- for a --.

Column 4,
Line 9, "to" should read -- to the --.
Line 13, "a" (2nd occurrence) should be deleted.
Line 47, after "developer" "the" should be deleted.

Column 5,
Line 43, "real-time" should read -- in real-time --.
Line 55, "to" should be deleted.

Column 7,
Line 13, "23(23a-23f)" should read -- 23(23a-23f)) --.
Line 50, "to" should be deleted.

Column 8,
Line 11, "that" should read -- that the --.
Line 33, "for" should read -- for the --.

Column 10,
Line 8, "FIG. 16)" should read -- (FIG. 16), --.

Column 11,
Line 47, "real-time" should read -- in real-time --, and "developer:" should read -- developer --.

UNITED STATES PATENT AND TRADEMARK OFFICE

CERTIFICATE OF CORRECTION

PATENT NO. : 6,253,036 B1
DATED : June 26, 2001
INVENTOR(S) : Toshiyuki Karakama et al.

It is certified that error appears in the above-identified patent and that said Letters Patent is hereby corrected as shown below:

Column 12,
Line 64, “any one of” should be deleted.

Column 13,
Line 6, “any one of” should be deleted.

Column 14,
Line 6, “any one of” should be deleted.
Line 9, “any one of” should be deleted.
Line 14, “any one of” should be deleted.
Line 56, “An” should read -- A --.

Column 15,
Line 28, “and” should be deleted.

Column 16,
Line 1, “any one of” should be deleted.
Line 50, “any one of” should be deleted.

Column 17,
Line 4, “device” should read -- part --.
Line 7, “device” should read -- part --.

Column 18,
Line 37, “at” should read -- at a --.

Signed and Sealed this

Twelfth Day of November, 2002

*Attest:*

*Attesting Officer*

JAMES E. ROGAN
*Director of the United States Patent and Trademark Office*